US010653923B2

(12) United States Patent
Ou

(10) Patent No.: US 10,653,923 B2
(45) Date of Patent: May 19, 2020

(54) CHANNELLESS BASKETBALL AND MANUFACTURING METHOD THEREOF

(71) Applicant: Tsung Ming Ou, Kaohsiung (TW)

(72) Inventor: Tsung Ming Ou, Kaohsiung (TW)

( * ) Notice: Subject to any disclaimer, the term of this patent is extended or adjusted under 35 U.S.C. 154(b) by 0 days.

(21) Appl. No.: 15/792,731

(22) Filed: Oct. 24, 2017

(65) Prior Publication Data

US 2019/0118044 A1 Apr. 25, 2019

(51) Int. Cl.

| | |
|---|---|
| ***A63B 41/08*** | (2006.01) |
| ***A63B 45/02*** | (2006.01) |
| ***A63B 41/10*** | (2006.01) |
| ***A63B 45/00*** | (2006.01) |

(52) U.S. Cl.

CPC ..... *A63B 41/08* (2013.01); *A63B 41/10* (2013.01); *A63B 45/00* (2013.01); *A63B 45/02* (2013.01); *A63B 2243/0037* (2013.01)

(58) Field of Classification Search

CPC . A63B 41/08; A63B 41/10; A63B 2243/0037; A63B 45/02; A63B 45/00

See application file for complete search history.

(56) References Cited

U.S. PATENT DOCUMENTS

| | | | | | |
|---|---|---|---|---|---|
| 2,149,465 | A * | 3/1939 | Riddell | B29D 22/02 | 156/147 |
| 2,280,314 | A * | 4/1942 | Scudder | B29C 51/16 | 156/213 |
| 3,508,750 | A * | 4/1970 | Henderson | A63B 39/00 | 473/605 |
| 3,512,777 | A * | 5/1970 | Henderson | A63B 41/08 | 473/597 |
| 5,306,001 | A * | 4/1994 | Shishido | A63B 41/00 | 473/604 |
| 5,542,662 | A * | 8/1996 | Kouzai | A63B 41/00 | 473/605 |
| 6,302,815 | B1 * | 10/2001 | Shishido | A63B 41/08 | 473/598 |
| 6,503,162 | B1 * | 1/2003 | Shishido | A63B 41/08 | 473/599 |
| 2006/0046880 | A1 * | 3/2006 | Tang | A63B 41/08 | 473/604 |
| 2006/0199685 | A1 * | 9/2006 | Ou | A63B 41/08 | 473/603 |
| 2009/0107617 | A1 * | 4/2009 | Ou | A63B 41/08 | 156/145 |
| 2009/0209374 | A1 * | 8/2009 | Ou | A63B 41/10 | 473/605 |
| 2009/0325747 | A1 * | 12/2009 | Ou | A63B 41/08 | 473/605 |
| 2010/0240479 | A1 * | 9/2010 | Raynak | A63B 41/08 | 473/604 |

(Continued)

*Primary Examiner* — Steven B Wong

(74) *Attorney, Agent, or Firm* — Raymond Y. Chan; David and Raymond Patent Firm

(57) ABSTRACT

A channelless basketball includes a bladder body without projection ribs and a bladder body which includes a plurality of cover panels attached on the bladder body in edge to edge manner to completely cover the bladder body. At least some of the cover panels are provided with gripping bands each of which is provided along the peripheral adjoining edge of the respective cover panel for providing good gripping and holding ability for the channelless basketball.

4 Claims, 13 Drawing Sheets

(56) References Cited

U.S. PATENT DOCUMENTS

| | | | | |
|---|---|---|---|---|
| 2012/0088614 | A1* | 4/2012 | Bulfin | A63B 41/08 473/604 |
| 2012/0142465 | A1* | 6/2012 | Berggren | A63B 41/08 473/604 |
| 2012/0231908 | A1* | 9/2012 | Fujikura | A63B 41/08 473/607 |
| 2012/0258824 | A1* | 10/2012 | Berggren | A63B 41/08 473/604 |
| 2012/0329587 | A1* | 12/2012 | Ou | A63B 41/08 473/605 |
| 2013/0005521 | A1* | 1/2013 | White | A63B 41/085 473/604 |
| 2013/0260927 | A1* | 10/2013 | Thurman | A63B 41/08 473/595 |
| 2014/0073465 | A1* | 3/2014 | Lee | A63B 41/08 473/604 |
| 2014/0179468 | A1* | 6/2014 | Berggren | A63B 41/08 473/604 |
| 2014/0179469 | A1* | 6/2014 | Berggren | A63B 45/00 473/604 |
| 2018/0078827 | A1* | 3/2018 | Berggren | A63B 45/00 |
| 2019/0091518 | A1* | 3/2019 | Dhirmalani | A63B 41/08 |

* cited by examiner

CHANNELLESS BASKETBALL AND MANUFACTURING METHOD THEREOF

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to sports ball, and more particularly to a channelless basketball which does not provide channels between cover panels and projection ribs protruded on the bladder while maintaining gripping ability and even better playing performance in sports.

Description of Related Arts

Easy to grip and hold is an essential factor in playing basketball. Also the spherical round shape may also affect the accuracy of shooting and passing of the basketball. A conventional basketball, as illustrated in FIG. 1, comprises a spherical bladder body 10P which is a hollow rubber bladder ball reinforced with lining layer therein and a valve 20P affixed thereto.

For the purpose of easy holding and gripping, the conventional bladder body 10P has a plurality of projection ribs 11P integrally protruded and extended thereon to define eight leaf shape panel recesses surrounded by the projection ribs lip defining eight panel recesses therebetween. The traditional basketball further comprises eight leaf shaped cover panels 30P having a shape of each of the panel recesses adapted to adhere in the eight panel recesses respectively. Each of the cover panels 30P comprises a cover layer made of leather or synthetic leather such as polyurethane (PU) or polyvinyl chloride (PVC). After the cover panels 30P adhered on the panel recesses of the bladder body 10P, the top surfaces of the projection ribs 11P form a plurality of channels between the cover panels 30P for ease of gripping and holding the basketball.

Accordingly, the bladder body 10P is not in spherical ball shape substantially and does not provide a round and smooth exterior surface that causes uneven stressing when being pressed. Although the presence of the projection ribs 11P and channels between the cover panels 30P enables the player to hold and grip the basketball easier, the projection ribs 11P and the cover panels 30P are not made of the same material that also adversely affects the flying, rolling and impacting performance of the basketball in air and ground respectively. Especially, when the player tries to rub the basketball against basketball backboard during shooting the basket, the rubbing of projection ribs 11P and the rubbing of the cover panels 30P against the basketball backboard are different and may produce different effects. In other words, the shooting or passing performance of the conventional basketball is not predictable at all.

In addition, it is obvious that the conventional basketball has two different kinds of stressed condition. One is directly forced on the ribs 11P of the bladder body 10P. The other is forced on the cover panels 30P which forced on the bladder body 10P indirectly. Thus, the resilience of the conventional basketball is not evenly provided around the exterior surface thereof.

Another shortage of the conventional basketball is that the accuracy of distance between the projection ribs 11P is highly required to fit the shape of the cover panels 30P. And the size of each cover panel 30P is required to be appropriate correspondingly. These raise the manufacturing complexity in production and the cost of manufacturing.

SUMMARY OF THE PRESENT INVENTION

The invention is advantageous in that it provides a channelless basketball and manufacturing method thereof, wherein the basketball has no channel provided and more even resilience provided on the basketball.

Another advantage of the present invention is to provide a channelless basketball and manufacturing method thereof, wherein the basketball comprises a plurality of gripping bands formed on the outer surface of the cover panels of the basketball for easy gripping and holding purposes.

Another advantage of the present invention is to provide a channelless basketball and manufacturing method thereof, wherein the gripping bands provided on the cover panels ensure the basketball meeting the shape and roundness requirements to ensure desired performance thereof.

Another advantage of the present invention is to provide a channelless basketball and manufacturing method thereof, wherein the bladder body of the channelless basketball has a spherical ball shape without any projection rib protruded thereon to ensure its roundness and the ball cover of the channelless basketball comprises a plurality of leaves of cover panels covering the bladder body in edge to edge manner integrally without any channel provided thereon to ensure the roundness of the basketball while maintaining the holding and gripping ability of the channelless basketball by the gripping bands provided on the cover panels. Accordingly, manufacture the basketball of the present invention is simplified by simply providing a round bladder body and attaching the cover panels around the bladder body that substantially reduces the complexity and cost of production of the basketball.

Another advantage of the present invention is to provide a channelless basketball and manufacturing method thereof, wherein the cover panels are affixing on the bladder body edge to edge for fully covering the bladder body, so as to completely enclose the bladder body by the cover panels and ensure an even resilience around the basketball for better rebounding and rubbing ability during shooting, bank shooting, ball handling, bouncing, and dribbling of the basketball.

Another advantage of the present invention is to provide a channelless basketball and manufacturing method thereof, wherein the stressed condition of the basketball is almost consistent all over on the outer surface of the basketball.

Another advantage of the present invention is to provide a channelless basketball and manufacturing method thereof, wherein the bladder body is relatively smooth and round in shape and has a generally even thickness for tightly fitting the cover panels for purpose of being more durable.

Another advantage of the present invention is to provide a channelless basketball and manufacturing method thereof, wherein the gripping bands formed on the cover panels each includes the seam formed between each two of the cover panels and an edge groove formed along the peripheral edges of the respective cover panel without providing any channel nor projection rib, so that the roundness of the basketball is ensured while having the same material and features provided all around the basketball.

Another advantage of the present invention is to provide a channelless basketball and manufacturing method thereof, wherein the optimal aesthetic of the basketball is maintained without any projection rib in black color as in the conventional basketball because the entire outer surface of the bladder body is covered by the cover panels.

Another advantage of the present invention is to provide a channelless basketball and manufacturing method thereof, wherein the bladder body has a plurality of alignment markers provided thereon for guiding the cover panels to align and attach correspondingly.

Additional advantages and features of the invention will become apparent from the description which follows, and may be realized by means of the instrumentalities and combinations particular point out in the appended claims.

According to the present invention, the foregoing and other objects and advantages are attained by a channelless basketball, comprising:

a ball shaped bladder body having a valve stem affixed thereon; and a plurality of cover panels attached on the bladder body, wherein the cover panels are attached on the bladder body in edge to edge manner so as to form a ball cover completely covering the bladder body while the valve stem extended to the ball cover for air inflation, wherein the ball cover further provides a plurality of gripping bands thereon adapted for ease of gripping and holding of the channelless basketball.

According to the present invention, each of the gripping bands provides a surface having protruded or indented means for increasing friction between the ball surface of the ball cover of the channelless basketball and the player's hand. In one embodiment, at least one of the gripping bands of at least one of the cover panels is extended along a peripheral edge of the cover panels. In one embodiment, each of the gripping bands has a gripping groove provided along the peripheral edge and an adjoining seam is formed between each of the two adjoining sides of the two adjacent cover panels. In one embodiment, the gripping groove and the adjoining seam are extended in parallel manner.

According to the present invention, the each of the cover panels is attached to the bladder body and closely adjoined with another cover panel in edge to edge manner.

In one embodiment, each of the adjoining seams is formed between two adjacent cover panels sealedly attached one the bladder body without exploding the bladder body outside.

According to the present invention, the alignment markers are lines slightly protruded or indented on the outer surface of the bladder body and being covered by the skin panels attached on the bladder body.

According to the present invention, the foregoing and other objects and advantages are also attained by a method of manufacturing a channelless basketball, comprising the steps of:

(a) air inflating a bladder body having a predetermined number of alignment markers provided on an outer surface thereof;

(b) aligning a predetermined number of cover panels along the alignment markers and attaching the cover panels on the bladder body to cover the outer surface bladder body with the cover panels;

(c) forming a plurality of gripping bands on the cover panels along the adjoining edges of the cover panels and covering the alignment markers with the adjoining edges of the cover panels; and (d) affixing the cover panels on the outer surface of the bladder body to form a ball cover completely enclosing and covering the bladder body.

According to the present invention, the step (c) further comprises a step of forming a plurality of adjoining seams along and between the adjoining edges of the cover panels respectively, while the adjoining edges of the two adjacent cover panels are pressing with each other.

In one embodiment, the step (b) further comprises a step of forming a plurality of gripping grooves on at least some of the cover panels along the adjoining edges of the cover panels respectively. In one embodiment, the gripping groove is parallel with the adjoining seam of the respective cover panel.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIG. 2 to FIG. 6 of the drawings, a channelless basketball according to a preferred embodiment of the present invention is illustrated. The channelless basketball comprises a bladder body 10 and a predetermined number of leaves of cover panels 31 covering the bladder body 10. Generally, eight cover panels 31 are used. The cover panels 31 are adapted to be attached on an outer surface of the bladder body 10 to form a ball cover 30 which substantially encloses and covers the bladder body 10 completely.

The rigidity and durability of the basketball merely depend on the cover panels 31 but not the soft rubber bladder body 10. The structure of the cover panels 31 must be tough enough to absorb all the impact force. Therefore, the outer coating layer of each of the cover panels 31, no matter it is made of leather or synthetic leather, is preferred to be further strengthened by affixing one more layer of coarsely lining thereon in order to better support the outer coating layer and resist the stress. The roundness and re-enforcement of the basketball depend on the strength of the lining cloth.

The bladder body 10 is a spherical bladder carcass which is a hollow rubber ball having a reinforcing lining layer enclosed therein and a valve stem 21 affixed thereto. U.S. Pat. No. 6,206,798, invented by the inventor of the present invention, general teaches the materials and structures of the bladder ball and cover panels, which is incorporated in the present invention by reference.

Figure 1:
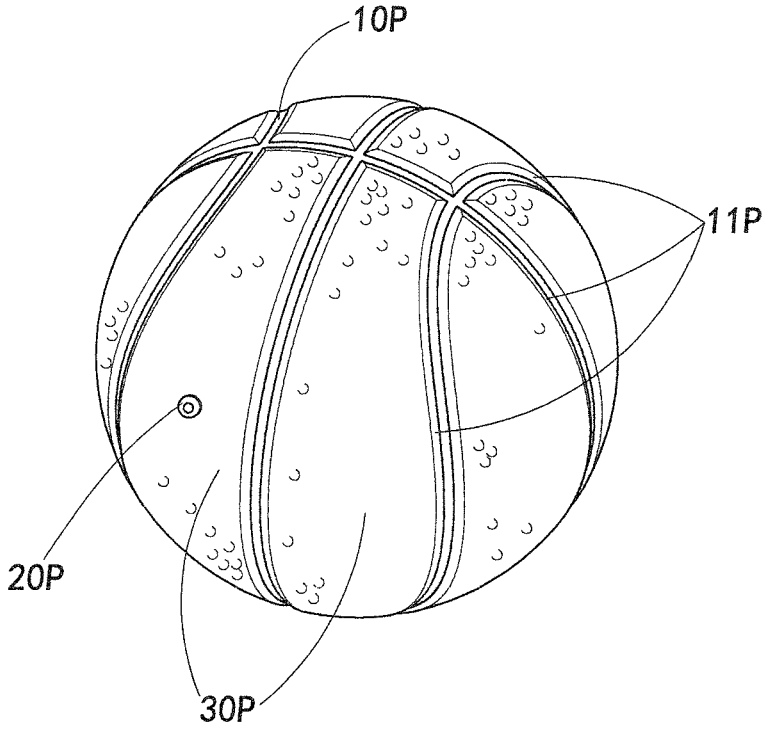
FIG. 1 is a perspective view of a conventional basketball.
Figure 2:
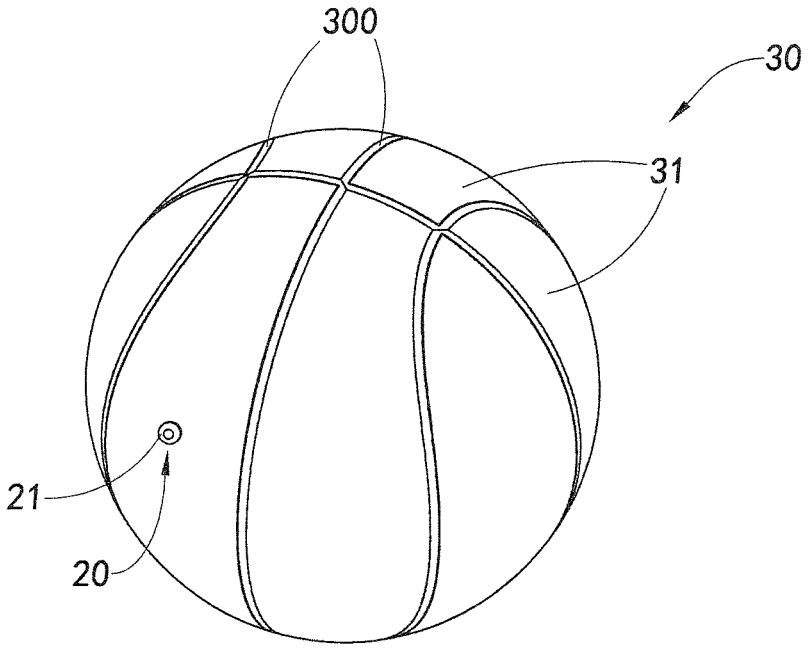
FIG. 2 is a perspective view of a channelless basketball according to a preferred embodiment of the present invention.

Correspondingly, the ball cover 30 further has a valve hole 20 with respect to the valve stem 21, so that the bladder body 10 can be inflated through the valve stem 21 extended from the bladder body 10 to the valve hole 20 of the ball cover 30. It is worth to mention that the outer surface of basketball is fully covered by the cover panels 31 of the ball cover layer except the valve stem 21, as illustrated in FIG. 2.

Figure 11:
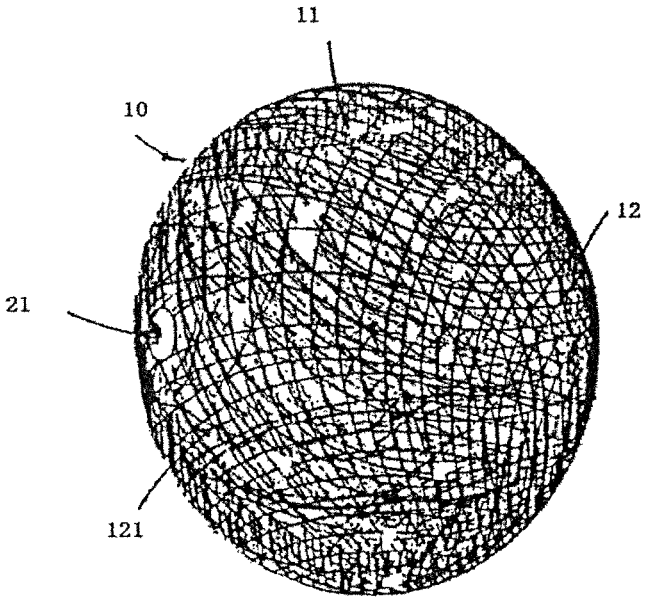
FIG. 11 is a perspective view illustrating one kind of the bladder body of the channelless basketball according to the above preferred embodiment of the present invention.
Figure 12:
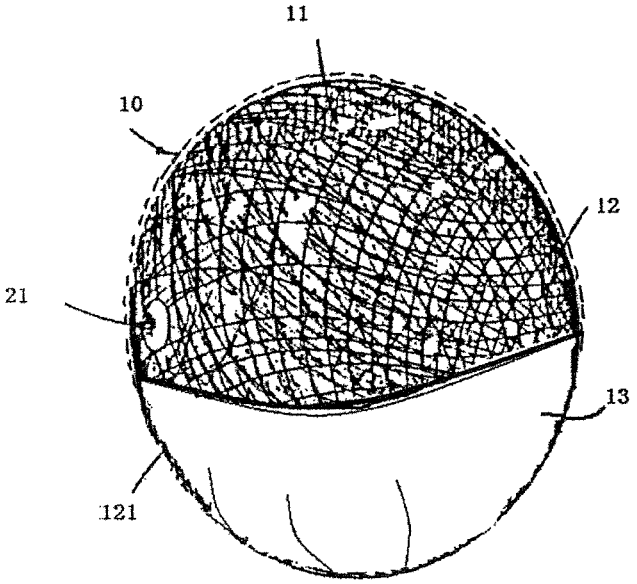
FIG. 12 is a perspective view illustrating another kind of the bladder body of the channelless basketball according to the above preferred embodiment of the present invention.

It is worth mentioning that, according to the preferred embodiment of the present invention, as shown in FIG. 11 and FIG. 12, the bladder body 10 comprises an inflatable bladder 11 and a web layer 12, wherein the inflatable bladder 11 is capable to be injected with air to form a ball shape, and the web layer 12 is adhered on an outer surface of the inflatable bladder 11. The web layer 12 is form by at least one strengthened thread 121 evenly wound around the outer surface of the inflatable bladder 11. According to the embodiment, the strengthened thread 121 is affixed to the outer surface of the inflatable bladder 11 with adhesive, such as resin, onto the inflatable bladder 11. The inflatable bladder 11 is entirely embraced by the web layer 12 with the valve stem 21 mounted thereon. According to the preferred embodiment of the present invention, the bladder body 10 further comprises a cover layer 13 which is overlapped on the web layer 12 and is treated to form an integral spherical structure of the bladder body 10. The cover layer 13 is made of expandable forming material which is thin when untreated, and when the cover layer 13 is heat-treated, and preferably vulcanized, the cover layer 13 is expanded to form a foaming cushion layer of bladder body 10.

Figure 3:
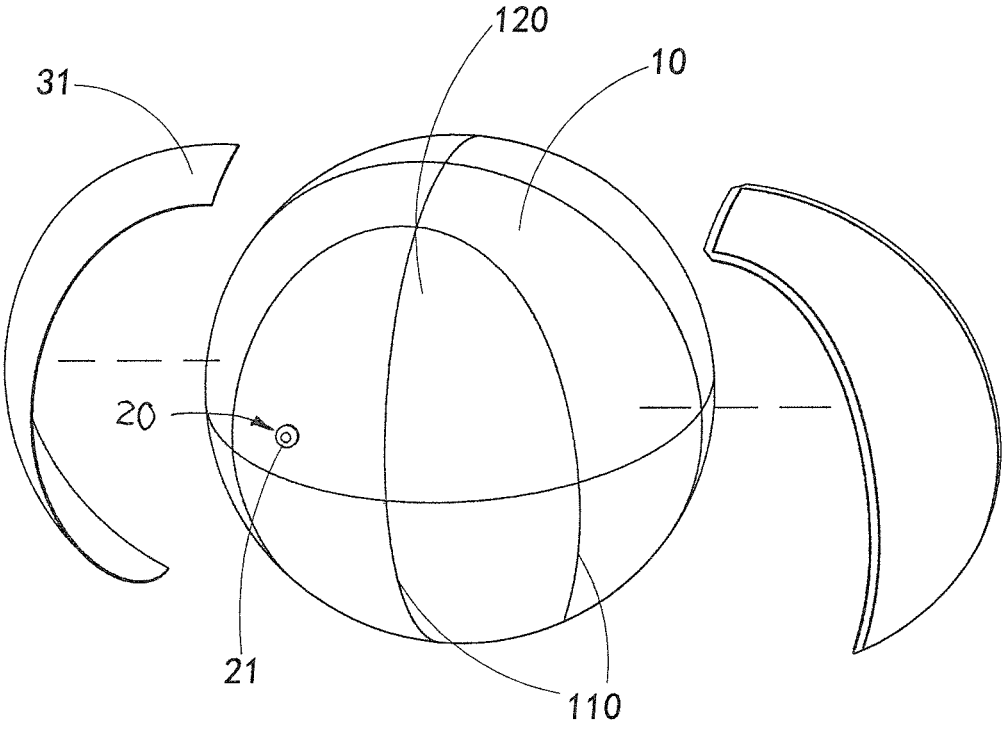
FIG. 3 is a partial exploded perspective view of the channelless basketball according to the above preferred embodiment of the present invention.
Figure 5:
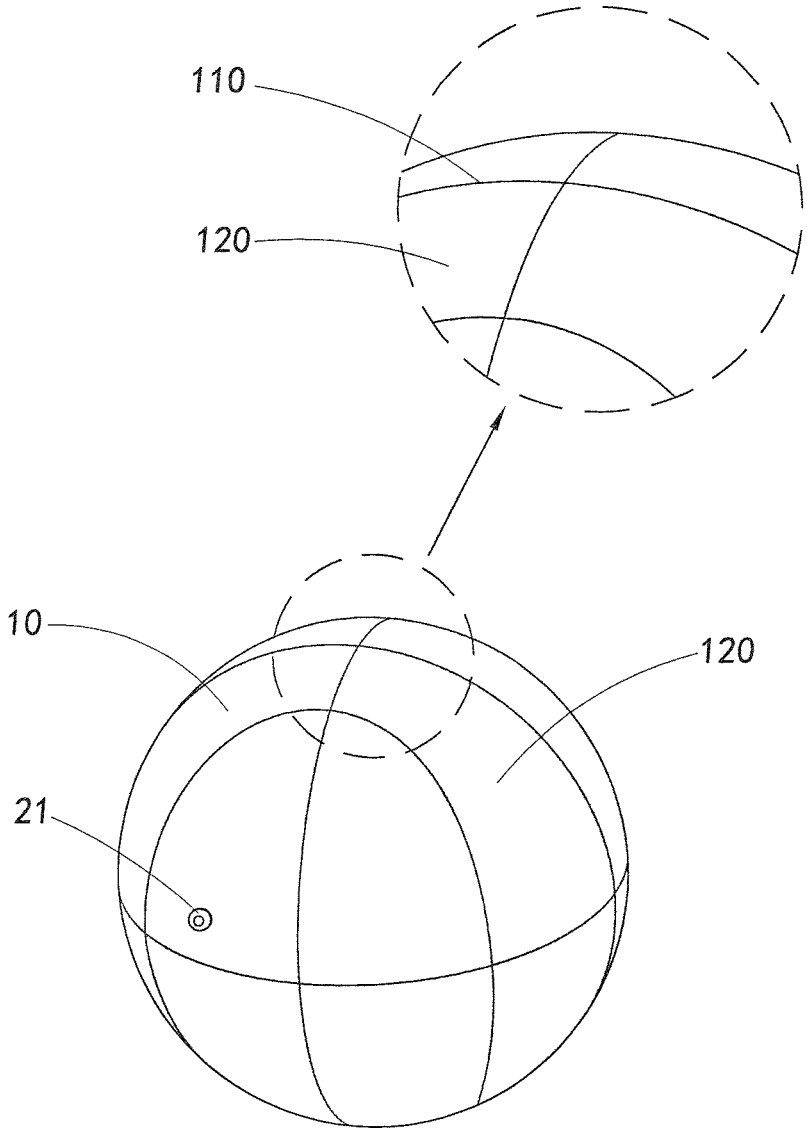
FIG. 5 is a perspective view of the bladder body of the channelless basketball according to the above preferred embodiment of the present invention.

As shown in FIG. 3, the bladder body 10 comprises a plurality of alignment markers 110 thereon, wherein the alignment markers 110 can be thin protruding lines protruded on the outer surface of the bladder body 10 as embodied in the preferred embodiment as shown in FIGS. 3 and 5, or alternatively, thin indented grooves indented or printed markers in different color printed on the outer surface of the bladder body 10, so as to define a plurality of affixing portions 120 between every two of the alignment markers 110.

Accordingly, if the bladder body 10 is adhered with the web layer 12 as shown in FIG. 11, the alignment markers 110 is preferred to be printed on the web layer 12. If the cover layer 13 is formed with the cover layer 13, the alignment markers 110 can be made as the thin protruding lines slightly protruded on the bladder body 10 or thin indenting grooves indented on the bladder body 10.

According to the preferred embodiment of the present invention, The eight leaf shaped cover panels 31 have shapes made corresponding to the eight affixing portions 120 defined on the bladder body 10. The eight leaves of cover panels 31 are adhered to the eight affixing portions 120 defined by the alignment markers 110 with the adjoining edges 312 of the cover panels 31 aligned with the alignment markers 110 respectively. The cover panels 31 are attached to the bladder body 10 and closely adjoined with each other in edge to edge manner. Since there is no protection rib protruded on the bladder body 10, the bladder body 10 is substantially in spherical ball shape. And, since all the affixing portions 120 are fully covered by the cover panels 31 respectively, the entire outer surface of the bladder body are covered by the cover panels 20 completely and the basketball is substantially even in roundness without channels formed.

Figure 4:
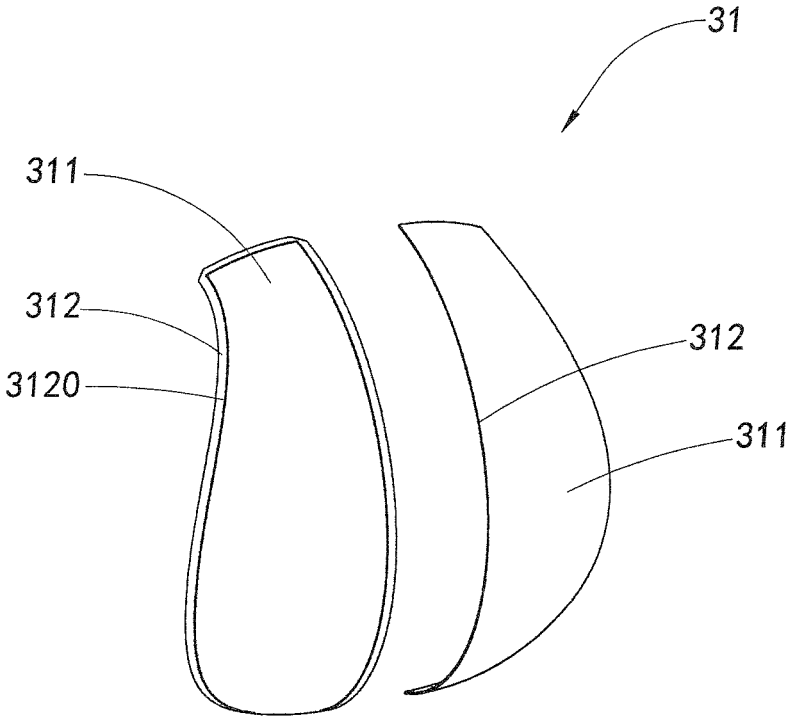
FIG. 4 is a perspective view of the cover panels of the channelless basketball according to the above preferred embodiment of the present invention.
Figure 6:
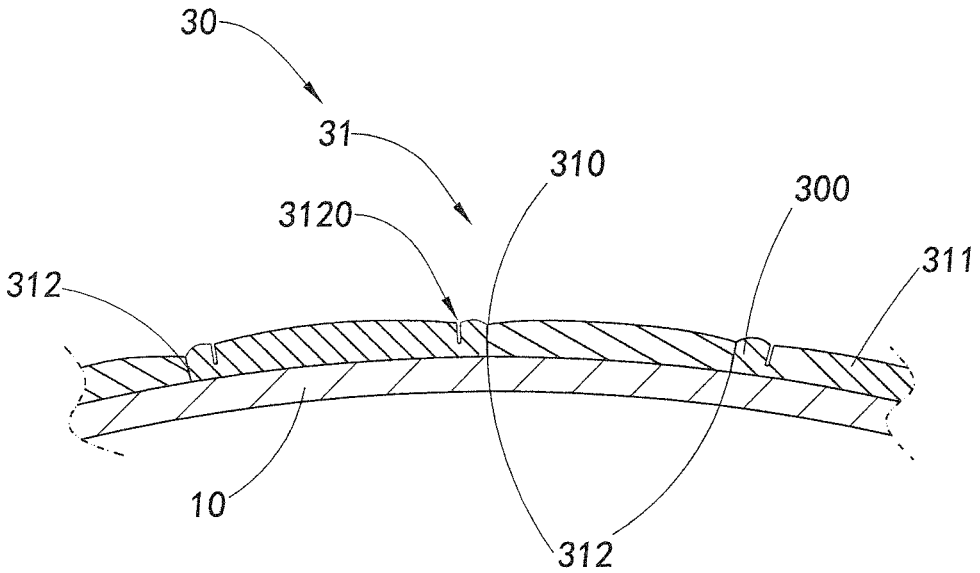
FIG. 6 is a partial sectional view of the channelless basketball according to the above preferred embodiment of the present invention.

According to the preferred embodiment of the present invention, as shown in FIG. 4, there are two types of cover panel 31' and 31". The first type cover skin 31' has an even thickness. The second type cover panel 31" has a cover panel body 311 and a peripheral gripping band 300 provided along the adjoining edge 312 formed along the periphery of the cover panel body 311. Preferably, the cover panels 31' and 31" are fittingly adhered to the adjacent affixing portions 120 in edge to edge manner with the respective adjoining edges 312 of the cover panels 31', 31" are biasing with each other side by side, as shown in FIG. 6.

At least one of the cover panels 31 has a valve hole 22 provided therein with respect to the position and size of the valve stem 21 so that when the respective cover panel 31 is adhered on the respective affixing portion 120 of the bladder body 10, as shown in FIGS. 2 and 3, the valve stem 21 fittingly extends through the valve hole 22 for air inflation of the bladder body 10.

Preferably, all the cover panels 31 of the ball bladder 30 are made of same kind of material, for example leather or synthetic leather, such as polyurethane or polyvinyl chloride, having the same resilience, so that since there is no channel and projection rib provided and the cover panels 31 of the ball cover 30 completely cover the bladder body 10, the channeless basketball of the present invention has a balance resilience and roundness all over to provide stable resilience for better rebounding and rubbing ability during shooting, bank shooting, ball handling, bouncing, and dribbling of the basketball.

According to the preferred embodiment of the present invention, in order to provide a good gripping and holding performance as well as a better adjoining connection between the adjoining edges 312 of the cover panels 31 adhered on the bladder body 10, each of the gripping bands 300 further has a peripheral gripping groove 3120 indented along the adjoining edge 312. Referring to FIGS. 2-4 and 6-7, each of the gripping grooves 3120 is preferred a roundness groove surrounding the peripheral adjoining edge 312 of the cover panel 31 (embodied as the second type cover panel 31") and parallel with the peripheral adjoining edge 312, defining an equal distance between the adjoining edge 312 and the gripping groove 3120. In other words, each of the gripping bands 300 is defined as the peripheral portion between the gripping groove 3120 and the adjoining edge 312 of the respective cover panel 31.

It is appreciated that the width and the depth of the gripping groove 3120 are arranged to provide a predetermined resilience and cushion ability for the gripping band 300 defined between the gripping groove 3120 and the respective adjoining edge 312, such that when the player grips on such gripping band 300, the gripping groove 3120 enables a slight movement of the gripping band 300 towards the gripping groove 3120, a compressible ability enabling the gripping band 300 deformation downwardly, and an increasing of friction with respect to the player's hand, so as to provide better gripping and holding performance for the channelless basketball of the present invention even though there is no channel and protection rib provided as in the conventional basketball.

Figure 7:
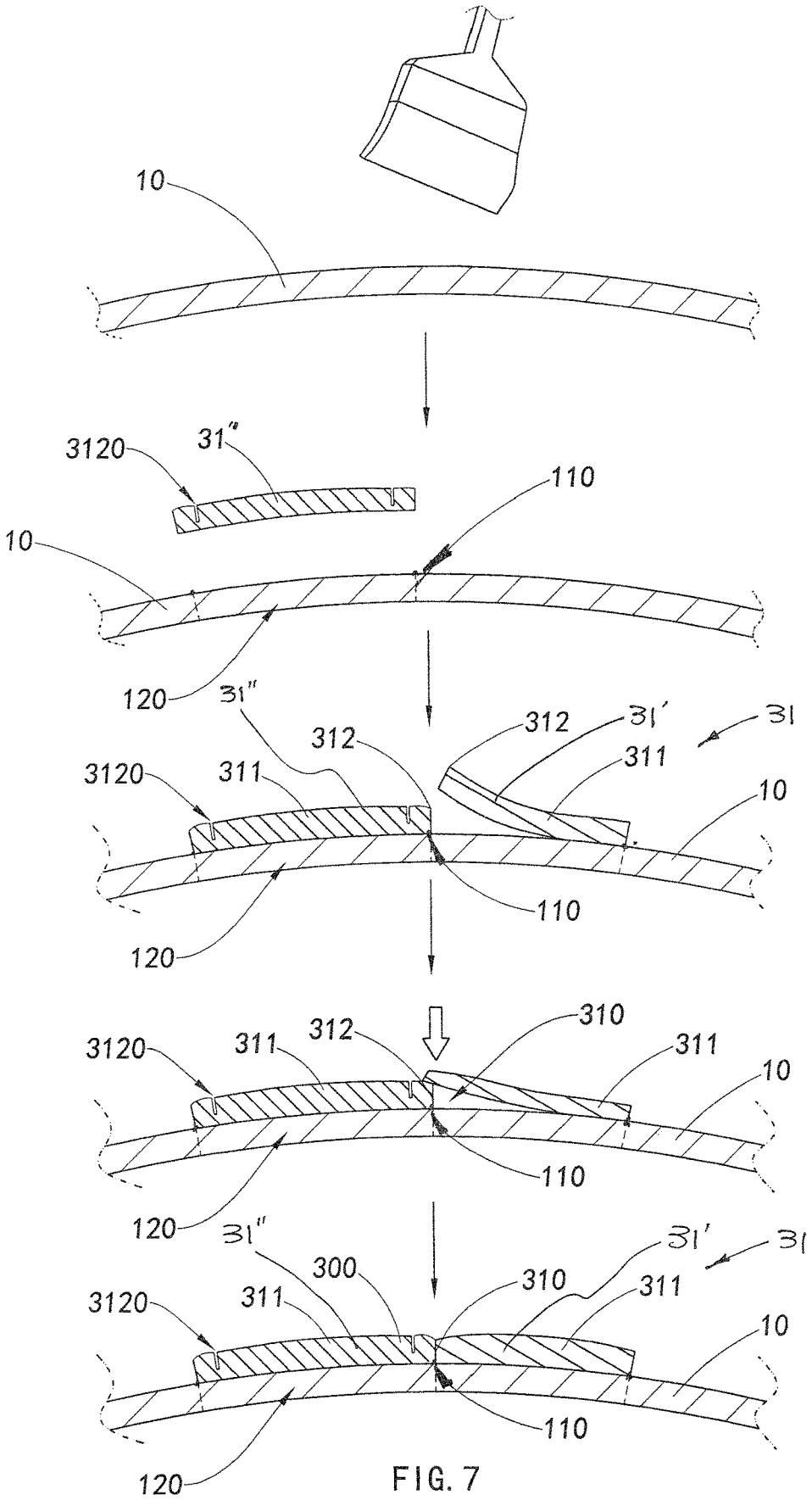
FIG. 7 is a flow diagram of a manufacturing method of a channelless basketball according to the above preferred embodiment of the present invention.

In addition, the gripping groove 3120 not only provides a non-smooth touch feeling when gripping the basketball, but also enables a more closely and tightly connection between the adjoining edges 312 of the first type and second type cover panels 31' and 31". As shown in FIGS. 6 and 7, to adhere the cover panels 31 on the bladder body 10, adhesive is applied evenly on the outer surface, including all affixing portions 120, of the bladder body 10 after it is inflated with a predetermined pressure of air. Then, the second type cover panel 31" is adhered to the respective affixing portion 120 of the bladder body 10 first. It is appreciated that, due to the presence of gripping groove 3120 of the second type cover panel 31", the first type cover panel 31' can be made to have a size slightly larger than the respective size of the affixing portion 120 and thus the adjoining edge 312 of the first type cover panel 31' is able to squeeze in while pressing the gripping band 300 of the adjoining second type cover panel 31" towards the gripping groove 3120 a little bit until the adjoining edges 312 of the two adjoining first type cover panel 31' and second type cover panel 31" are fittingly adhered on the bladder body 10 side by side.

Figure 6A:
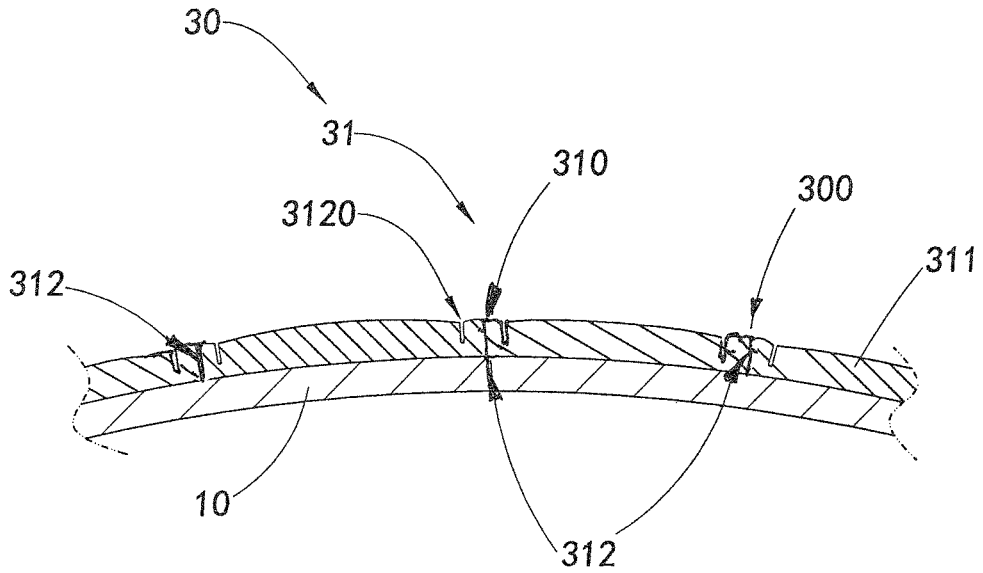
FIG. 6A is a partial sectional view illustrating an alternative mode of ball cover of the channelless basketball according to the above preferred embodiment of the present invention.

It is worth mentioning that all cover panels 31 can be made as the second type cover panel 31" while the width of each of the gripping bands 300 is reduced to half, i.e. the distance between the gripping groove 3120 and the adjoining edge 312 is reduced in 50%, so that when two adjacent cover panels 31 are adhered to two adjacent affixing portions 120 in edge to edge manner, the two adjoining edges 312 of the two adjoining cover panels 31 can be squeezed side by side together by means of the resilience provided to the two half-width gripping bands 300 by the two gripping grooves 3120, as shown in FIG. 6A, to combine the two half-width gripping bands 300 to form a complete gripping band performing similarly to the above preferred embodiment as shown FIG. 6.

The affixing portions 120 of the bladder body 10 defined by the alignment markers 110, as shown in FIG. 5, as well as the alignment markers 110 are covered by the cover panels 31 while the ball cover 30 fully enclosing the bladder body 10.

Accordingly, as shown in FIG. 6, the bladder body 10 is inflated to a substantially spherical shape. The cover panels 31 are attached to the bladder body 10 by adhesive to form the ball cover 30 covering the entire bladder body 10, wherein each two of the cover panels 31 are closely squeezing to each other forming a connection seam 310 between the every two of the cover panels 31, preferably along the respective alignment marker 110.

It is worth mentioning that when the gripping grooves 3120 of the second type cover panel 31" is as thin as a slit, the squeezing pressure from the adjoining edge 312 of the adjacent first type cover panel 31' may also compress the gripping band 300 to prop up on the ball cover 30, i.e. a little bit higher than the outer surface of the channelless basketball, to enable the player to feel for ease of holding and gripping the channelless basketball. Alternatively, a thickness of the gripping bands 300 are also able to be made slightly thinner than the cover panel body 311 of the cover panel 31, so that the gripping bands 300 are slightly lower than the outer surface of the channelless basketball that also enables the player to feel for ease of holding and gripping the channelless basketball. In other words, the gripping bands 300 are not another additional skin made of different material than the cover panels 31 but are made of the same material and constructed to provide the gripping ability and performance.

In order to meet the standard requirements of basketball, the gripping bands 300 are adapted to be formed to increase the friction with hands when gripping and holding the channelless basketball. Also, the gripping bands 300 helps to keep stable of the channelless basketball when flying in air with the gripping groove 3120 and the connection seam 310.

Referring to FIG. 7 of the drawings, a method of manufacturing the channelless basketball as disclosed above is illustrated according to the above preferred embodiment of the present invention, wherein the manufacturing method comprises the steps of:

(a) inflating the bladder body 10 to a spherical ball shape;

(b) attaching the cover panels 31 with the gripping band 300, that is the second type cover panel 31" according to the above preferred embodiment, along the alignment markers 110 the bladder body 10;

(c) attaching the cover panels 31 without the gripping band 300, that is the first type cover panel 31' according to the above preferred embodiment, adjacent to the cover panels with the gripping band 300 in edge to edge manner on the bladder body 10; and (d) setting the adjoining edges of the cover panels 31 attached on the bladder body 10 side by side to form the ball cover 30 completely covering the bladder body 10.

According to the preferred embodiment, the step (b) further comprises a step of forming a plurality of gripping bands on the cover panels along the adjoining edges of the cover panels and covering the alignment markers with the adjoining edges of the cover panels.

According to the preferred embodiment of the present invention, between the step (a) and the step (b), the manufacturing method further comprises a step of applying a layer of adhesive on the outer surface of the bladder body 10 and the cover panels 31 are adhered on the bladder body 10.

The step (d) further comprises a step of squeezing the adjoining edge 312 of the cover panel 31 without the gripping band 300 to press against the adjoining edge 312 of the gripping band 300 of the adjacent cover panel 31 with the gripping band 300 until the two adjoining edges 312 are pressing against with each other side by side tightly and fully adhered on outer surface of the bladder body 10.

The step (d) may further comprises a step of pressing the adjoining edge 312 of the cover panel 31 with the gripping band 300 by the adjoining edge 312 of the cover panel 31 without the gripping band 300 to deform towards the gripping groove 3120 of the gripping band 300 until the gripping groove 3120 is eliminated and, optional, the gripping band 300 is slightly protruded above the cover panels 31.

More specifically, the bladder body 10 is inflated firstly, but the bladder body 10 has no need to be fully inflated, as long as the affixing portions 120 of the bladder body 10 are clearly shown. Secondly, the cover panels 31 with the gripping grooves 3120 (second type cover panels 31") are affixed to the bladder body 10. According to the preferred embodiment, the cover panels 31 with the gripping grooves 3120 are aligned to the alignment markers 110 to be arranged on the respective affixing portions 120 respectively. After affixing the cover panels 31 with the gripping grooves 3120, the bladder body 10 can release some air to a semi-inflating state to provide more flexibility for the bladder body 10 for attaching the cover panels 31 without the gripping grooves 3120 (the first type cover panels 31'). The grooveless cover panels 31 (the first type cover panels 31') are affixed to the bladder body 10 adjacent to the cover panels 31 already affixed on the bladder body 10. It is similar as the cover panels 31 with the gripping groove 3120 (the second type cover panels 31") that each of the grooveless cover skin 31 (the first type cover panels 31') is aligned to the alignment markers 110 to be arranged on the respective affixing portions 120 correspondingly. Then, the adjoining edges of 312 of adjoined the cover panels 31 are settled by pressing against each other side by side, as shown in FIG. 7. Usually, the adjoining edges 312 of the cover panels 31 with the gripping grooves 3120 are pressed tightly on the bladder body 10. And the other adjoining edges 312 of the grooveless cover panels 31 (the first type cover panels 31') are tucked for making the adjoining edges 312 against with and squeeze with each other. By repeating the above steps of affixing and settling steps (a) to (c), the cover panels 31 can be attached by adhesive on the bladder body 10 one after one to form the ball cover 30 to enclose the bladder body 10 to form the channelless basketball.

Figure 8:
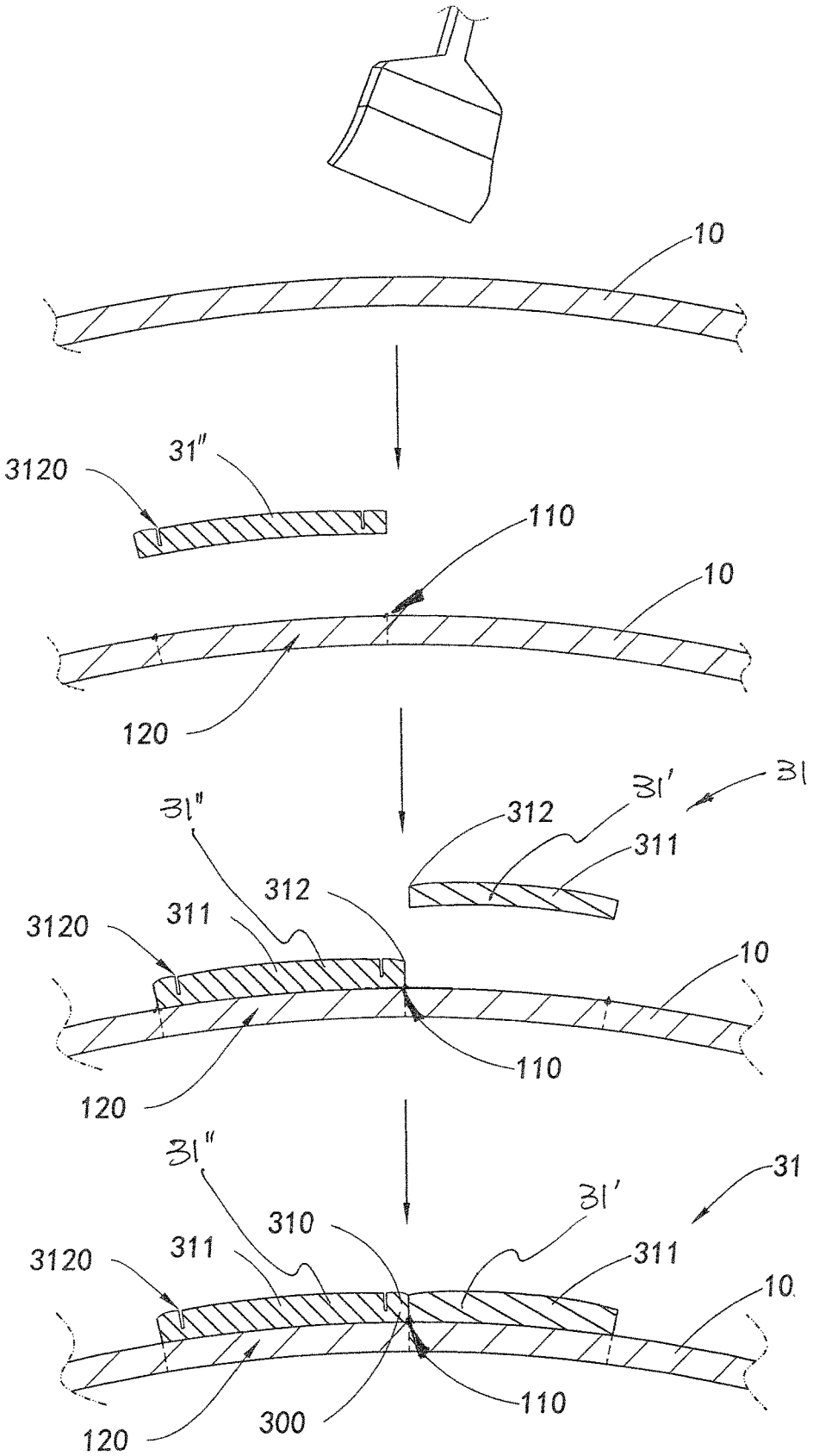
FIG. 8 is a flow diagram of an alternative mode of the manufacturing method of a channelless basketball according to an alternative mode of the manufacturing method of the above preferred embodiment of the present invention.

Referring to the FIG. 8, an alternative mode of the manufacturing method of the channelless basketball according to the above preferred embodiment of the present invention is illustrated, wherein the size of the cover panels 31 (including both the first type and the second type cover panels 31', 31") are same as the corresponding affixing portions 120 on the bladder body 10, so that after the step (b), the first type cover panels 31' are simply fitted to adhere on the respective affixing portions 120 respectively between the second type cover panels 31", so that the gripping grooves 3120 of the second type cover panels 31" are remained opened and the gripping bands 300 are not being squeezed by the first type cover panel 31' to provide a resilience for the gripping bands 300 for gripping and holding purposes.

Figure 9A:
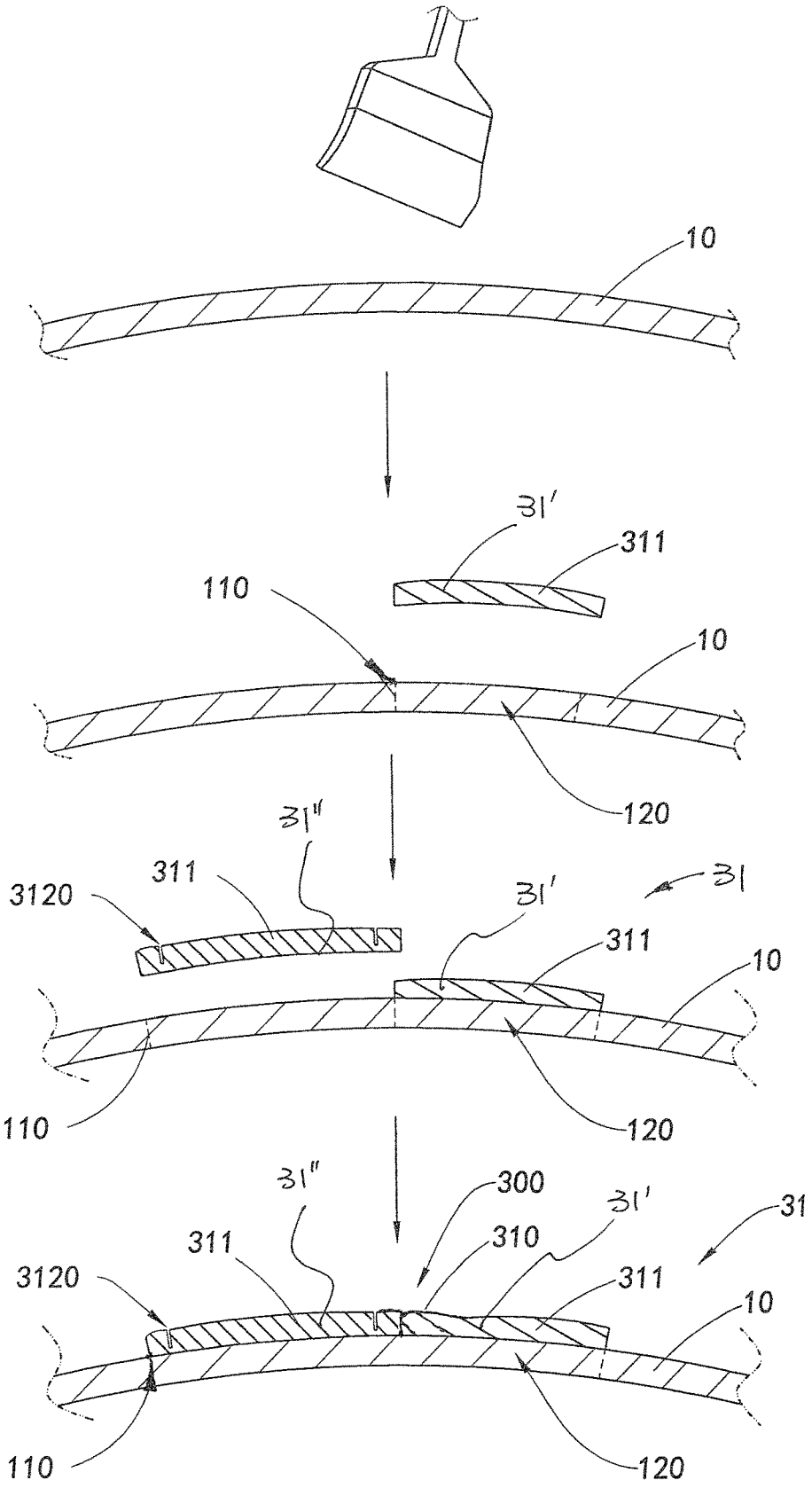
FIG. 9A is a flow diagram of an alternative mode of the manufacturing method a channelless basketball according to another alternative mode of the manufacturing method of the above preferred embodiment of the present invention.
Figure 9B:
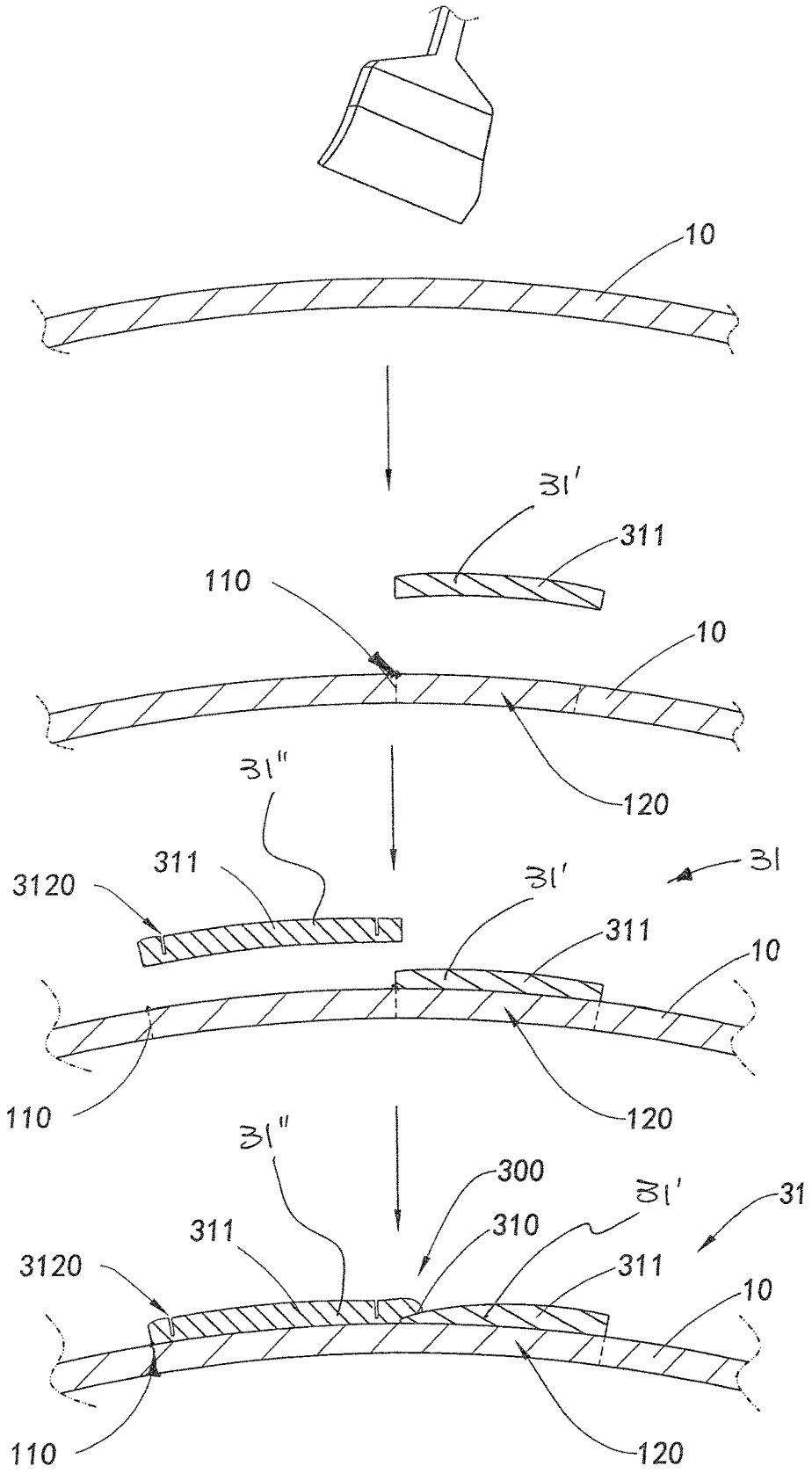
FIG. 9B is a flow diagram of an alternative mode of the manufacturing method a channelless basketball according to another alternative mode of the manufacturing method of the above preferred embodiment of the present invention.

Referring to the FIG. 9B, another alternative mode of the manufacturing method of the channelless basketball according to the above preferred embodiment of the present invention is illustrated, wherein the step (b) and step (c) are changed with each other. That is the grooveless cover panels 31 (first type cover panels 31') are attached to the bladder body 10 first, and then the cover panels 31 with the gripping grooves 3120 (second type cover panels 31") are attached on the bladder body 10 adjacent to the grooveless cover panels 31 (first type cover panels 31') with at least an outer portion of each of the adjoining edges 312 of the second type cover panels 31" is adhered to overlap on an outer portion of the adjoining edge 312 of adjacent first type cover panel 31' adhered on the bladder body 10 already, so that the gripping band 300 is padded to protrude on the ball cover 30 of the channelless basketball.

Figure 10:
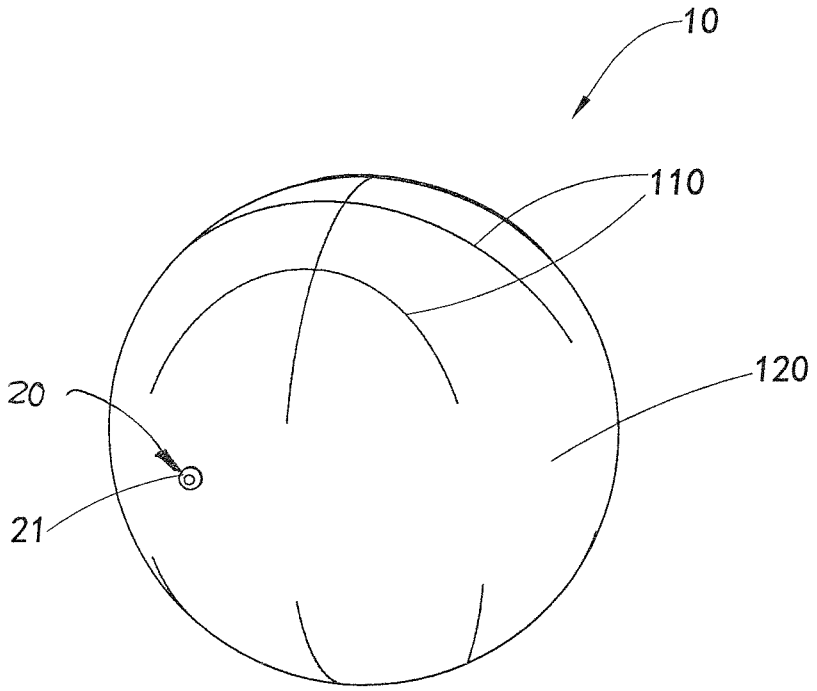
FIG. 10 is a perspective view of the bladder body of the channelless basketball according to an alternative mode of the bladder body of the above preferred embodiment of the present invention.

Additionally, an alternative mode of the alignment marker 110 of the bladder layer 10 is shown in FIG. 10 according to the preferred embodiment of the present invention. The alignment markers 110 is printed or formed on the bladder layer 10 to define the affixing portions 120 corresponding to the cover panels 31. The alignment markers 110, as shown in FIG. 10, are partial marks adapted for providing and two ends of the affixing portions 120 for each of the cover panels 31 to be aligned and attached thereon. Likewise, the alignment marker 110 of the bladder body 10 can be lines drawn or printed on the bladder layer 10. Or, alternatively, the alignment markers 110 can be molded to protrude on the bladder body 10 or made by protruding threads integrally formed with the bladder layer 10.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A channelless basketball, comprising:

a bladder body having a ball shape and a valve stem thereon; and a plurality of cover panels attached on said bladder body, wherein said cover panels are attached on said bladder body in edge to edge manner so as to form a ball cover completely covering said bladder body while said valve stem is extended to said call cover for air inflation, wherein said ball cover further provides a plurality of gripping bands protruded above an outer surface of said cover panels for ease of gripping and holding of the basketball, wherein a thickness of each of said gripping bands is larger than a thickness of each of said cover panels, wherein each of said cover panels has a peripheral adjoining edge that when said cover panels are attached on said bladder body, said peripheral adjoining edges of two of said cover panels are squeezed to protrude above said cover panels to form said gripping band, wherein said gripping bands are formed on and protruded from one or more of said cover panels respectively, wherein said gripping band on said cover panel is formed at said peripheral portion thereof and extended along a peripheral adjoining edge of said cover panel, wherein each of said cover panels with said gripping band provided thereon is attached adjacent with one of said cover panels without said gripping band on said bladder body with said adjoining edges thereof connected side by side.

2. The channelless basketball, as recited in claim 1, wherein each of said cover panels having said gripping band further has a gripping groove indented therein along said adjoining edge of said cover panel such that a peripheral portion between said adjoining edge and said gripping groove defines said gripping band.

3. The channelless basketball, as recited in claim 1, wherein a plurality of alignment markers is provided on said bladder body to define a plurality of affixing portions, wherein said affixing portions are sized and shaped according to sizes and shapes of said cover panels respectively and said cover panels are aligned along said alignment markers to adhere on said affixing portions respectively.

4. The channelless basketball, as recited in claim 2, wherein a plurality of alignment markers is provided on said bladder body to define a plurality of affixing portions, wherein said affixing portions are sized and shaped according to sizes and shapes of said cover panels respectively and said cover panels are aligned along said alignment markers to adhere on said affixing portions respectively.

* * * * *